US009248339B2

(12) United States Patent
Lo

(10) Patent No.: US 9,248,339 B2
(45) Date of Patent: Feb. 2, 2016

(54) ELLIPTICAL TRAINER

(71) Applicant: DK City Corporation, Taichung (TW)

(72) Inventor: Chiu Hsiang Lo, Taichung (TW)

(73) Assignee: DK CITY CORPORATION, Taichung (TW)

( * ) Notice: Subject to any disclaimer, the term of this patent is extended or adjusted under 35 U.S.C. 154(b) by 116 days.

(21) Appl. No.: 13/975,285

(22) Filed: Aug. 24, 2013

(65) Prior Publication Data

US 2015/0057129 A1 Feb. 26, 2015

(51) Int. Cl.
*A63B 22/06* (2006.01)
*A63B 22/00* (2006.01)

(52) U.S. Cl.
CPC ..... *A63B 22/0664* (2013.01); *A63B 22/0015* (2013.01); *A63B 22/001* (2013.01)

(58) Field of Classification Search
CPC ..... A63B 22/0664; A63B 22/001; A63B 21/225; A63B 2022/067; A63B 22/0015
USPC ..... 482/51, 52, 57–65
See application file for complete search history.

(56) References Cited

U.S. PATENT DOCUMENTS

| | | | | |
|---|---|---|---|---|
| 6,612,969 | B2 * | 9/2003 | Eschenbach | 482/51 |
| 7,559,879 | B2 * | 7/2009 | Anderson et al. | 482/57 |
| 7,811,206 | B2 * | 10/2010 | Chuang et al. | 482/52 |
| 7,887,465 | B2 * | 2/2011 | Uffelman | 482/52 |
| 8,113,995 | B1 * | 2/2012 | Hsu | 482/52 |
| 8,449,437 | B1 * | 5/2013 | Maresh et al. | 482/52 |

* cited by examiner

*Primary Examiner* — Stephen Crow
(74) *Attorney, Agent, or Firm* — Muncy, Geissler, Olds & Lowe, P.C.

(57) ABSTRACT

An elliptical trainer includes a base, a post, a circular movement unit, two elliptical movement units and a stride-adjusting device. The post and the circular movement unit are supported on the base. Each elliptical movement unit includes a swing bar and a pedal carrier. The pedal carrier includes a front end pivotally connected to a lower end of the swing bar and a rear end pivotally connected to the circular movement unit. The stride-adjusting device includes a power unit and a lever set. The power unit is supported on the post. The lever set includes a middle portion pivotally connected to the post, an end pivotally connected to the power unit, and another end pivotally connected to the swing bars. The power unit is operable to pivot the lever set to move upper ends of the swing bars to change the strides of the elliptical movement units.

10 Claims, 7 Drawing Sheets

ELLIPTICAL TRAINER

BACKGROUND OF INVENTION

1. Field of Invention

The present invention relates to an exercise machine and, more particularly, to an elliptical trainer with an adjustable strides.

2. Related Prior Art

There has been a first type of exercise machines with which users exercise to build their bodies. Such exercise machines can be called the "strength trainers." There has been a second type of exercise machines with which users exercise to enhance their cardiopulmonary function. The second type of exercise machines includes treadmills, stationary bikes and elliptical trainers.

An elliptical trainer is used to guide a user to move his feet along two identical elliptical strides with long axes lying substantially horizontally. The length of the long axes of the elliptical strides is expected to match with the length of the legs of the user. Conventionally, the length of the long axes of the elliptical strides of the elliptical trainer is fixed. That is, the long axes of the elliptical strides of the elliptical trainer may be too short for users with long legs or too long for users with short legs.

To solve the above-mentioned problem, various devices are devised for adjusting the elliptical strides of elliptical trainers. Such devices can be seen in Chinese Patent 101234241, Taiwanese Patent Application Publication 201200203, Taiwanese Patent M415718 and US Patent Application Publication Nos. 20030236152, 20040009847, 20040147375, 20050043145 and 20120122632.

Therefore, the present invention is intended to obviate or at least alleviate the problems encountered in prior art.

SUMMARY OF INVENTION

It is the primary objective of the present invention to provide an elliptical trainer with adjustable strides.

To achieve the foregoing objective, the elliptical trainer includes a base, a post, a circular movement unit, two elliptical movement units and a stride-adjusting device. The base is placed on a supporting face. The post is supported on the base. The circular movement unit is supported on the base. Each of the elliptical movement units includes a swing bar and a pedal carrier. The swing bar is formed with an upper end and a lower end. The pedal carrier includes a front end pivotally connected to the lower end of the swing bar and a rear end pivotally connected to the circular movement unit. The stride-adjusting device includes a power unit and a lever set. The power unit is supported on the post. The lever set includes a middle portion pivotally connected to the post, an end pivotally connected to the power unit, and another end pivotally connected to the swing bars. The power unit is operable to pivot the lever set to move the upper ends of the swing bars to change the strides of the elliptical movement units.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
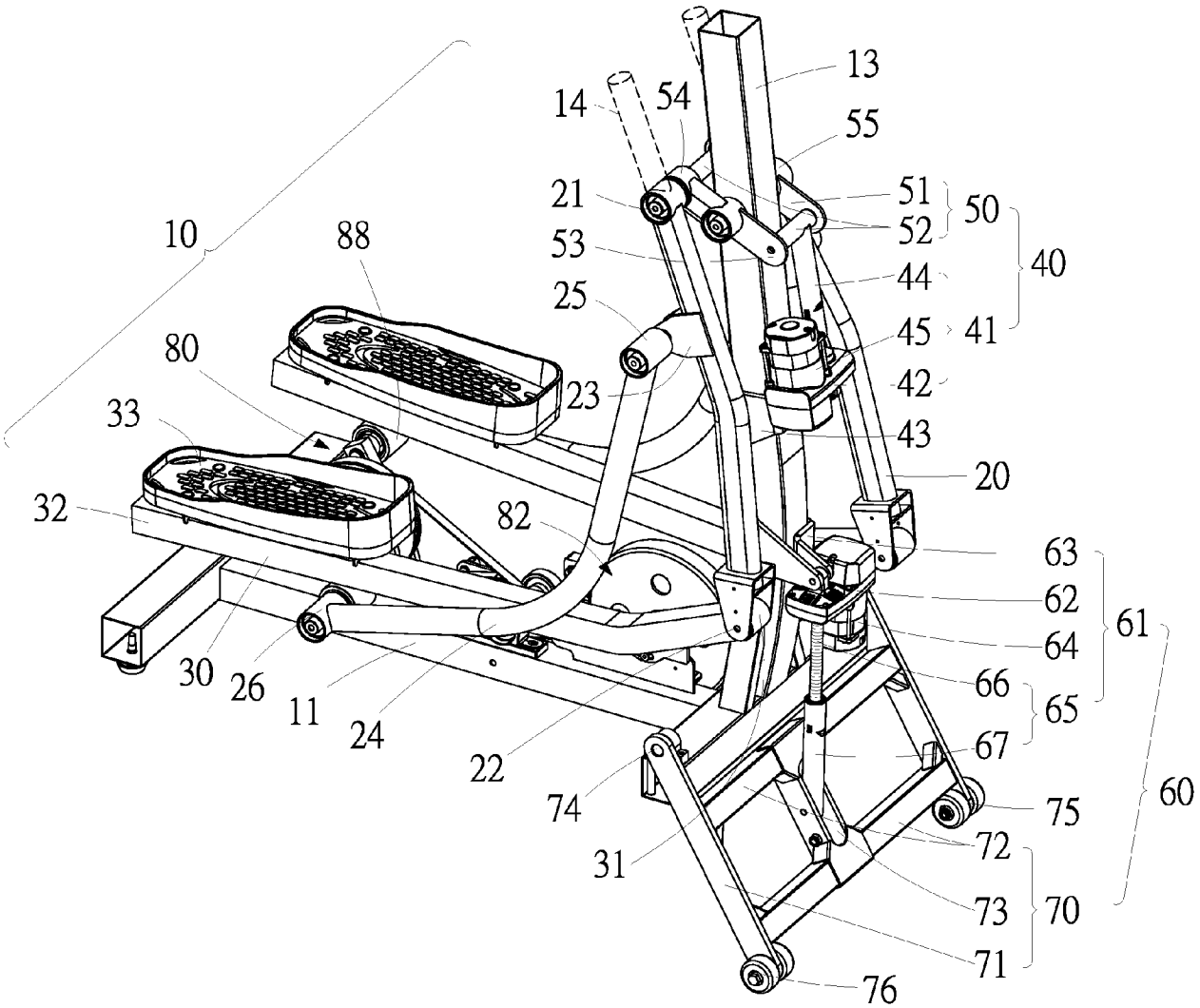
FIG. 1 is a perspective view of an elliptical trainer according to the preferred embodiment of the present invention.
Figure 6:
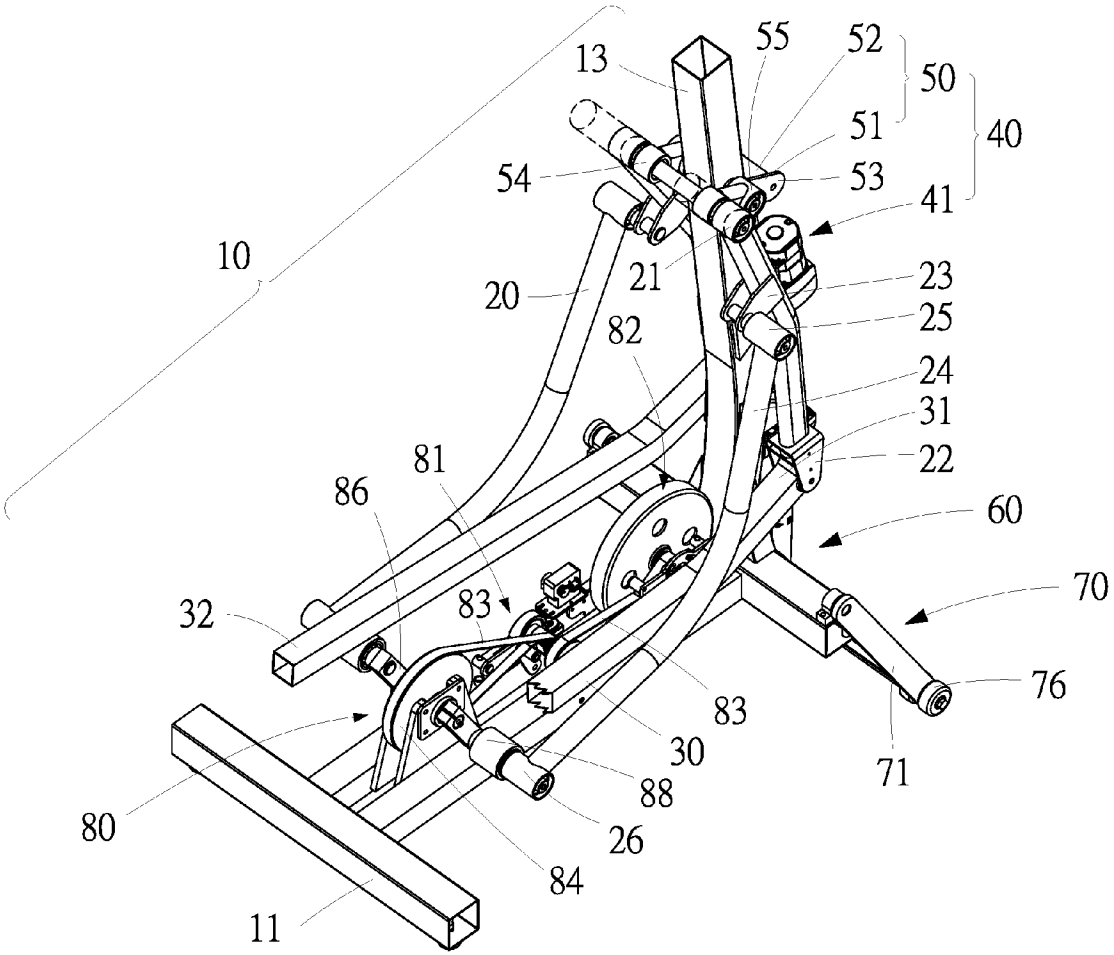
FIG. 6 is a partial view of the elliptical trainer shown in FIG. 1.
Figure 7:
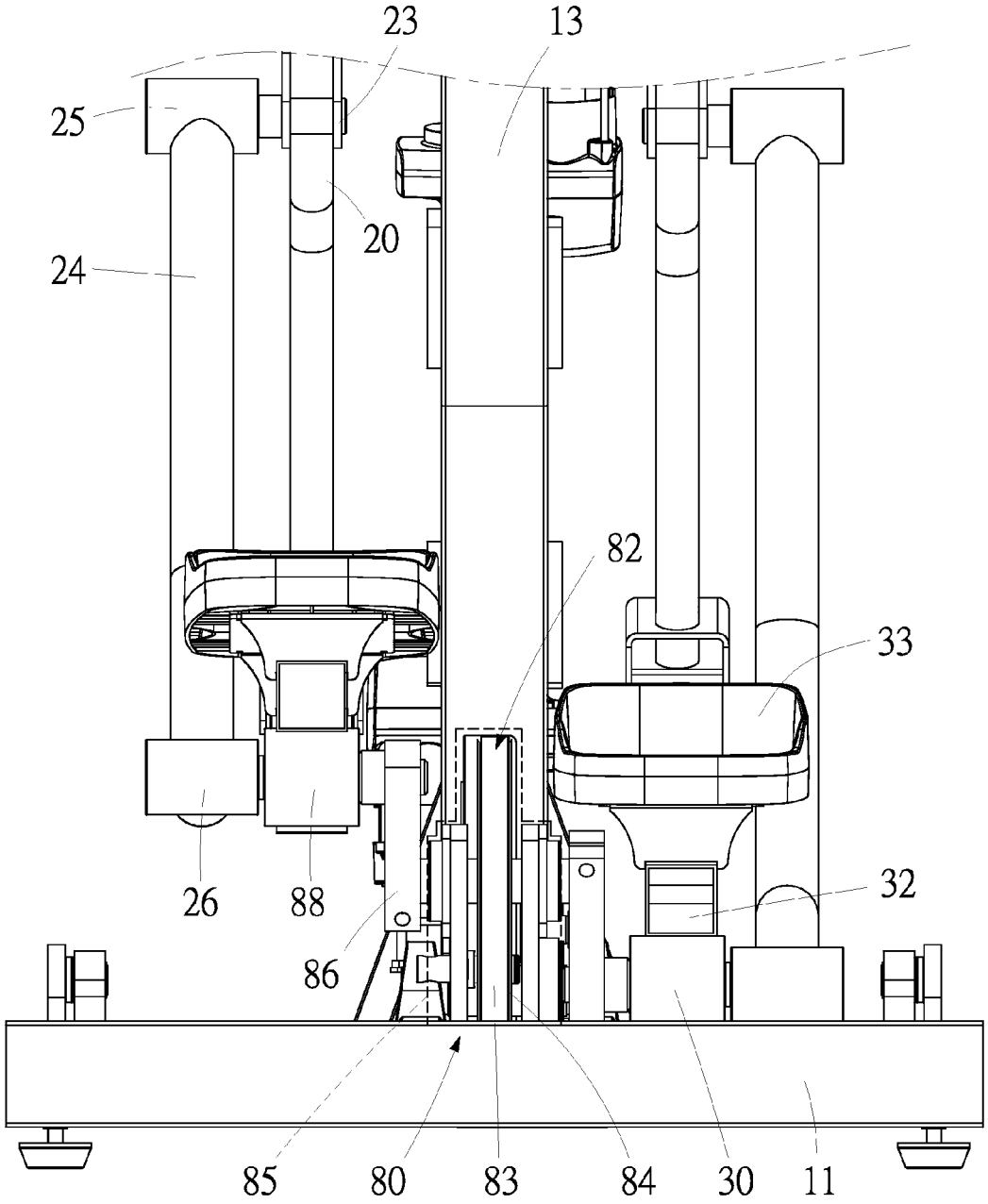
FIG. 7 is a partial, rear view of the elliptical trainer shown in FIG. 1.

Referring to FIGS. 1, 6 and 7, there is an elliptical trainer 10 according to the preferred embodiment of the present invention. The elliptical trainer 10 includes a frame, two elliptical movement units, a stride-adjusting device 40, a simulating device 60, a driving unit 80 and a damping unit 82.

The frame includes a base 11 and a post 13. The base 11 includes two longitudinal bars placed between and secured to a front crossbar and a rear crossbar so that the base 11 is an H-shaped element. The base 11 is placed on a supporting face 12 such as the ground and a floor. The post 13 is secured to the front crossbar of the base 11, near the connection of the front crossbar to the longitudinal bars.

The stride-adjusting device 40 includes a power unit 41 and a lever set 50. The lever set 50 includes two levers 51, a front crossbar 52 and a rear crossbar 52. Each of the levers 51 includes a middle portion 55 between a front end 53 and a rear end 54. Two ends of the front crossbar 52 are pivotally connected to the front ends 53 of the levers 51 while two ends of the rear crossbar 52 are pivotally connected to the rear ends 54 of the levers 51. The middle portion 55 of each of the levers 51 is pivotally connected to the post 13.

The power unit 41 includes a platform 42, two brackets 43, an extensible element 44 and a motor 45. The brackets 43 are secured to the post 13 by welding for example. The platform 42 is pivotally linked to the brackets 43. The motor 45 is supported on the platform 42. The extensible element 44 includes a threaded rod 46 and a threaded sleeve 47. The threaded rod 46 is formed with a thread on an eternal side while the threaded sleeve 47 is formed with a thread on an internal side. The threaded rod 46 is inserted in and engaged with the threaded sleeve 47. The threaded rod 46 is operatively connected to the motor 45. The threaded sleeve 47 is connected to the front crossbar 52.

The elliptical movement units are identical to each other structurally. Each of the elliptical movement units includes a first swing bar 20, a second swing bar 24 and a pedal carrier 30. The first swing bar 20 includes a middle portion 23 between an upper end 21 and a lower end 22. The second swing bar 24 includes an upper end 25 and a lower end 26. The pedal carrier 30 includes a front end 31 and a rear end 32. The upper end 21 of the first swing bar 20 is pivotally connected to the rear end 54 of a corresponding of the levers 51. The upper end 25 of the second swing bar 24 is pivotally connected to the middle portion 23 of the first swing bar 20. The front end 31 of the pedal carrier 30 is pivotally connected to the lower end 22 of the first swing bar 20. A middle portion of the pedal carrier 30 is pivotally connected to the lower end 26 of the second swing bar 24. A pedal 33 is supported on the pedal carrier 30, near the rear end 32.

The damping unit 82 is placed on the longitudinal bars of the base 11. The damping unit 82 is operated based on wind drag, friction or magnetism. It should be understood that the damping unit 82 includes a rotational element for rotation relative to a stationary element supported on the longitudinal bars of the base 11 although this is not clearly shown.

The driving unit 80 includes a pulley set 81, a front belt 83, a rear belt 83, a fly wheel 84, a shield 85, two cranks 86, and two bearings 88. The pulley set 81 is supported on the longitudinal bars of the base 11. The pulley set 81 is operatively connected to a motor (not numbered). The front belt 83 is wound on the pulley set 81 and the damping unit 82. The rear belt 83 is wound on the pulley set 81 and the fly wheel 84. The damping unit 82 and the fly wheel 84 are covered by the shield 85. Each of the cranks 86 includes an end connected to the fly wheel 84 and another end pivotally connected to the lower end 26 of the second swing bar 24 of a corresponding one of the elliptical movement units.

The simulating unit 60 is used to simulate the slope of the road. The simulating unit 60 includes a power unit 61 and a lever set 70. The lever set 70 includes two levers 71, a longitudinal bar 73, an upper crossbar 72 and a lower crossbar 72. Each of the levers 71 includes a middle portion between an upper end 74 and a lower end 75. The upper ends 74 of the levers 71 are pivotally connected to the front crossbar of the base 11. At least one caster 76 is connected to the lower end 75 of each of the levers 71. The crossbars 72 are placed between and connected to the levers 71. The longitudinal bar 73 is connected to the crossbars 72.

The power unit 61 includes a platform 62, two brackets 63, a motor 64 and an extensible element 65. The brackets 63 are connected to the post 13 by welding for example. The platform 62 is pivotally connected to the brackets 63. The motor 64 is placed beneath and connected to the platform 62. The extensible element 65 includes a threaded rod 66 and a threaded sleeve 67. The threaded rod 66 is formed with a thread on an eternal side while the threaded sleeve 67 is formed with a thread on an internal side. The threaded rod 66 is inserted in and engaged with the threaded sleeve 67. The threaded rod 66 is connected to the motor 64. The threaded sleeve 67 is connected to the longitudinal bar 73.

Figure 2:
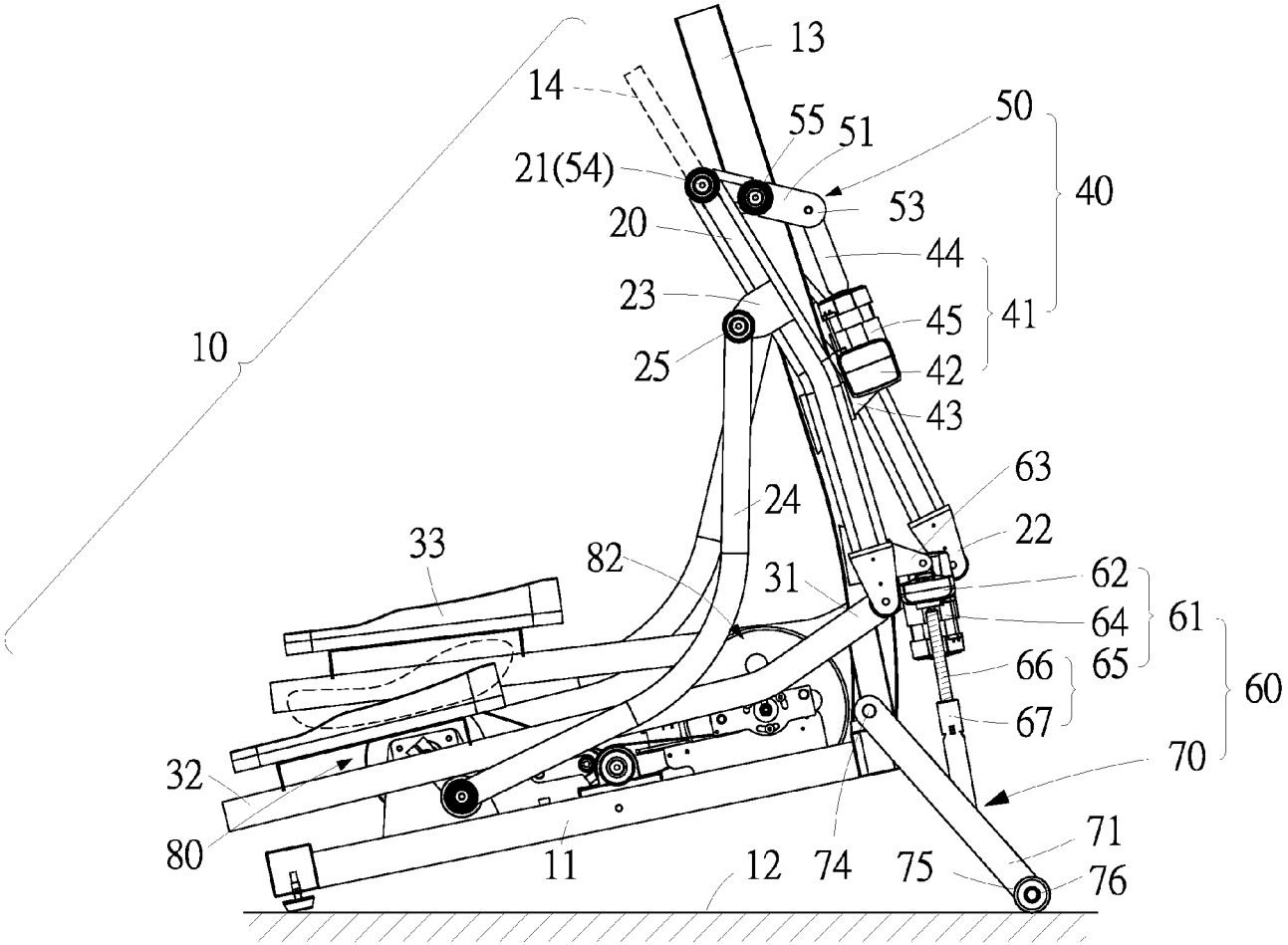
FIG. 2 is a side view of the elliptical trainer shown in FIG. 1.
Figure 3:
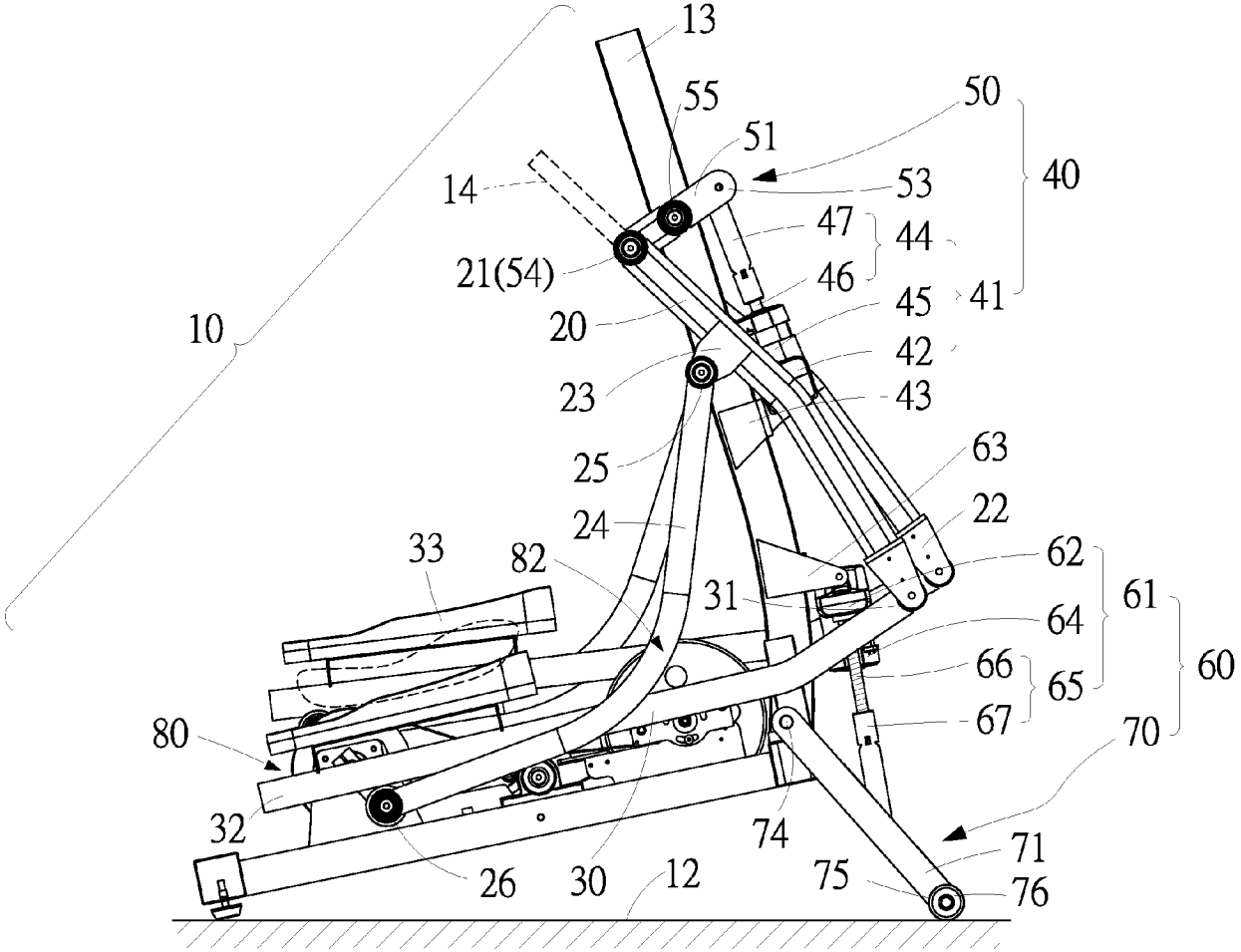
FIG. 3 is a side view of the elliptical trainer in another position than shown in FIG. 2.

Referring to FIGS. 2 and 3, the stride-adjusting device 40 is operable to adjust the strides of the pedals 33. The motor 45 can be used to rotate the threaded rod 46 in the threaded sleeve 47 in a direction to shrink the extensible element 44 to the smallest length as shown in FIG. 2. Now, the upper end 21 of the first swing bar 20 is moved to the highest position. The angle between the first swing bar 20 and the second swing bar 24 is at the smallest value. The motor 45 can be used to rotate the threaded rod 46 in the threaded sleeve 47 in an opposite direction to extend the extensible element 44 to the largest length as shown in FIG. 3. Now, the upper end 21 of the first swing bar 20 is moved to the lowest position. The angle between the first swing bar 20 and the second swing bar 24 is at the largest value.

Figure 4:
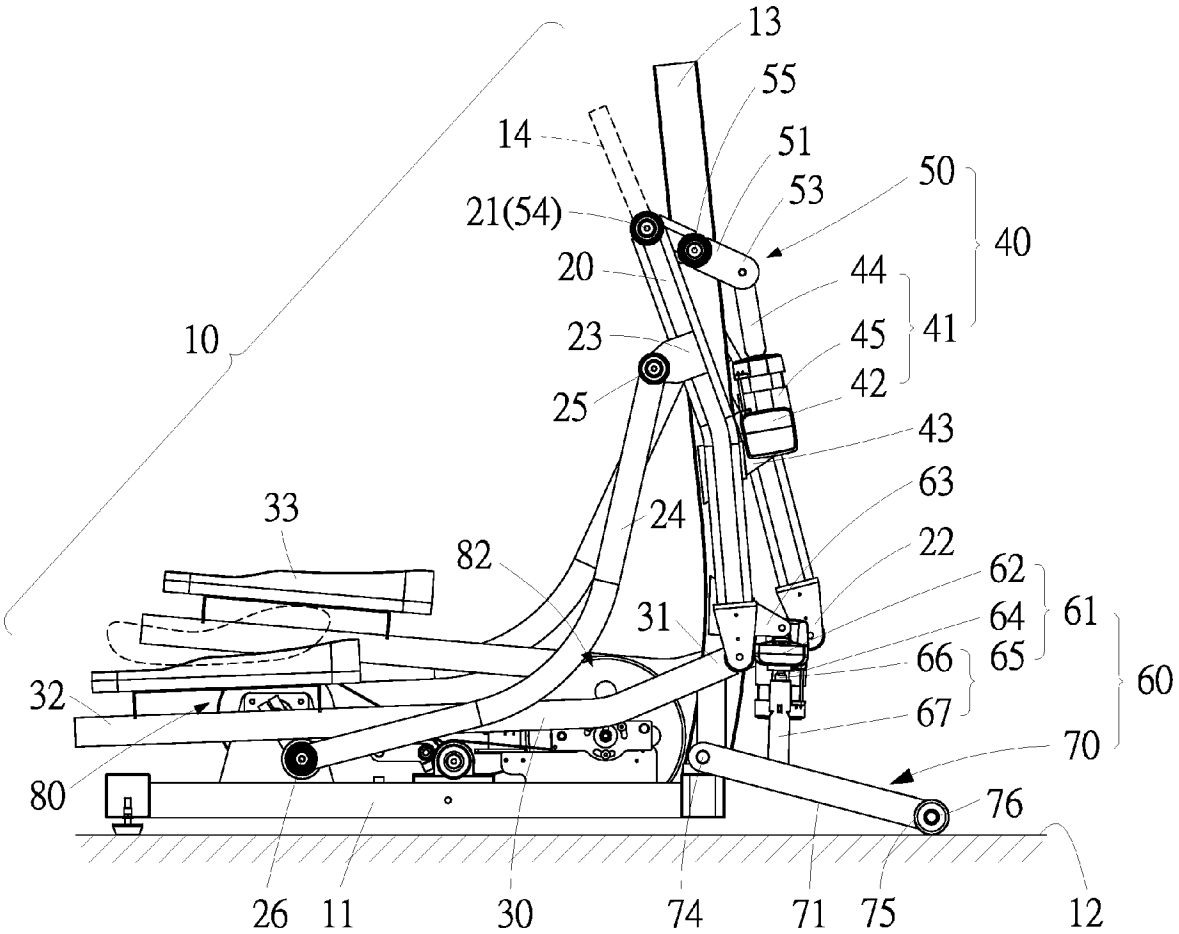
FIG. 4 is a side view of the elliptical trainer in another position than shown in FIG. 3.
Figure 5:
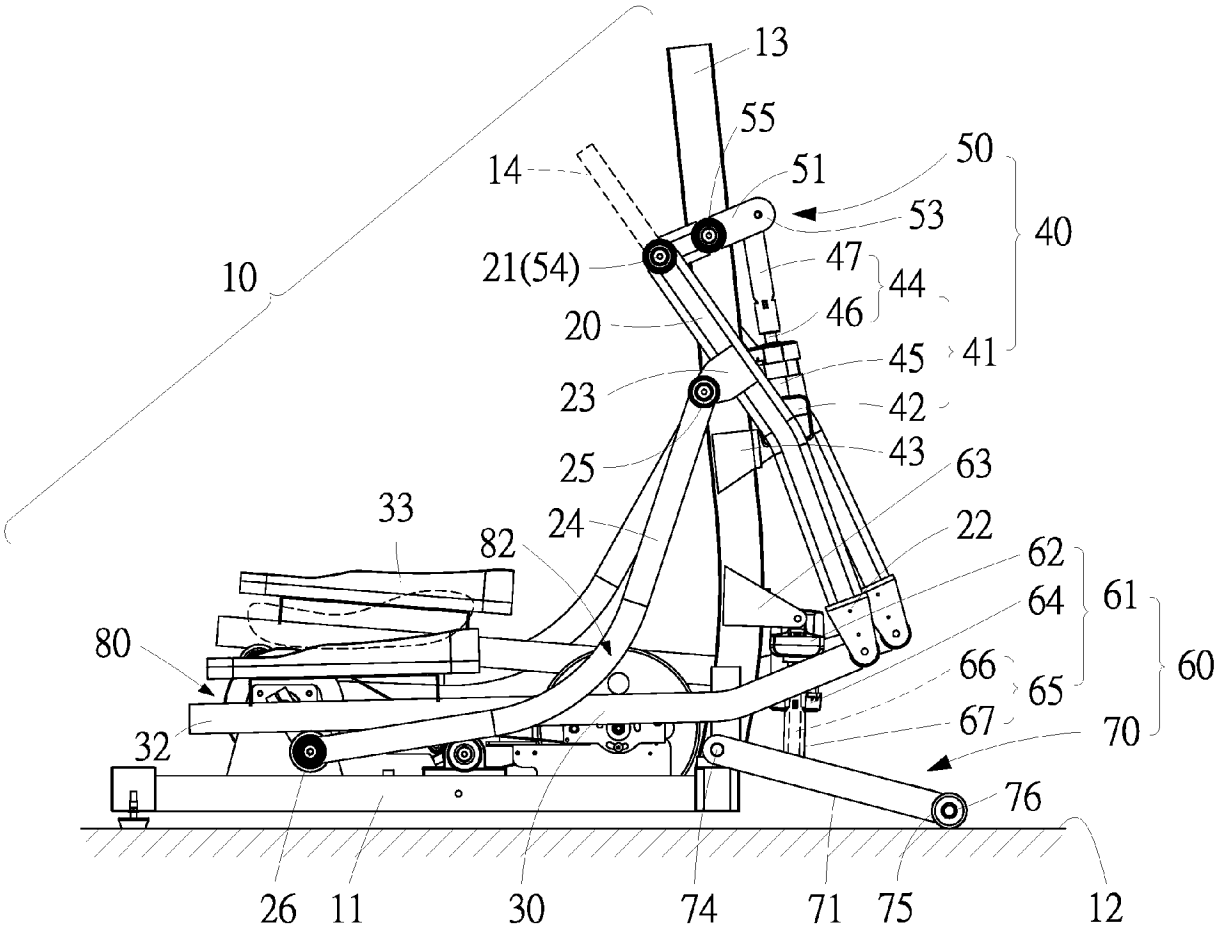
FIG. 5 is a side view of the elliptical trainer in another position than shown in FIG. 4.

Referring to FIGS. 4 and 5, the simulating device 60 is operable to adjust the slope of the base 11. The motor 64 can be used to rotate the threaded rod 66 in the threaded sleeve 67 in a direction to shrink the extensible element 65 to the smallest length as shown in FIG. 4. Now, the upper ends 74 of the levers 71 are in the lowest position. The slope of the base 11 is at the smallest value. The motor 64 can be used to rotate the threaded rod 66 in the threaded sleeve 67 in an opposite direction to extend the extensible element 65 to the largest length as shown in FIG. 5. Now, the upper ends 74 of the levers 71 are in the lowest position. The slope of the base 11 is at the largest value.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An elliptical trainer including:
- a base placed on a supporting face;
- a post supported on the base;
- a circular movement unit supported on the base;
- two elliptical movement units each including a major swing bar and a pedal carrier, wherein the major swing bar is formed with an upper end and a lower end, wherein the pedal carrier includes a front end pivotally connected to the lower end of the major swing bar and a rear end pivotally connected to the circular movement unit; and
- a stride-adjusting device including:
  - a power unit supported on the post; and
  - a lever set including a middle portion pivotally connected to the post, an end pivotally connected to the power unit, and another end pivotally connected to the major swing bars, wherein the power unit is operable to pivot the lever set to move the upper ends of the major swing bars to change the strides of the elliptical movement units.

2. The elliptical trainer according to claim 1, wherein the lever set includes:
- two levers each including a middle portion pivotally connected to the post; and
- two crossbars placed between and connected to the levers, wherein one of the crossbars is pivotally connected to the upper ends of the major swing bars while the other crossbar is pivotally connected to the power unit.

3. The elliptical trainer according to claim 1, wherein the power unit includes:
- a platform pivotally connected to the post;
- a motor supported on the platform; and
- an extensible element including an end connected to the corresponding crossbar of the lever set and another end connected to the motor so that the length of extensible element is changeable by the motor.

4. The elliptical trainer according to claim 3, wherein the extensible element includes:
- a threaded rod connected to the motor; and
- a threaded sleeve engaged with the threaded rod at an end and connected to the corresponding crossbar of the lever set at another end.

5. The elliptical trainer according to claim 4, wherein each of the elliptical movement units includes a minor swing bar formed with an upper end pivotally connected to a middle portion of the major swing bar and a lower end pivotally connected to the rear end of the pedal carrier.

6. The elliptical trainer according to claim 5, including a simulating device including:
- a simulator-used power unit supported on the post; and
- a simulator-used lever set pivotally connected to the base at an end and pivotally connected to the simulator-used power unit at another end, wherein the simulator-used power unit is operable to pivot the simulator-used lever set to change the slope of the base.

7. The elliptical trainer according to claim 6, wherein the simulator-used power unit includes:
- a simulator-used platform pivotally connected to the post;
- a simulator-used motor supported on the simulator-used platform; and
- a simulator-used extensible element including an end connected to the simulator-used lever set and another end connected to the simulator-used motor so that the length of simulator-used extensible element is changeable by the simulator-used motor.

8. The elliptical trainer according to claim 7, wherein the simulator-used extensible element includes:

a simulator-used threaded rod connected to the simulator-used motor; and a simulator-used threaded sleeve engaged with the simulator-used threaded rod at an end and connected to the simulator-used lever set at another end.

9. The elliptical trainer according to claim 8, wherein the simulator-used lever set includes:

two simulator-used levers each including an upper end pivotally connected to the base and a lower end for contact with the supporting surface; and two simulator-used crossbars placed between and connected to the simulator-used levers; and a longitudinal bar connected to the simulator-used crossbars, wherein the longitudinal bar is pivotally connected to the simulator-used power unit.

10. The elliptical trainer according to claim 9, wherein the simulator-used lever set includes two casters each connected to the lower end of a corresponding one of the simulator-used levers.

* * * * *